United States Patent [19]

Akerman et al.

[11] Patent Number: 4,806,406

[45] Date of Patent: Feb. 21, 1989

[54] SANITARY TOILET SEAT COVER

[76] Inventors: Marina J. Akerman; David Akerman, both of 8417 Hidden Trail La., Spring, Tex. 773790

[21] Appl. No.: 82,201

[22] Filed: Aug. 6, 1987

[51] Int. Cl.[4] ..... A47K 13/14

[52] U.S. Cl. ..... 428/65; 428/81; 4/242

[58] Field of Search ..... 428/65, 81; 4/242–247

[56] References Cited

U.S. PATENT DOCUMENTS

| | | | |
|---|---|---|---|
| 963,792 | 7/1910 | Miller | 4/243 |
| 1,358,222 | 11/1920 | Levy | 4/242 |
| 4,634,618 | 1/1987 | Greer et al. | 428/81 |

FOREIGN PATENT DOCUMENTS

| | | | |
|---|---|---|---|
| 1387994 | 3/1975 | United Kingdom | 4/242 |

*Primary Examiner*—Alexander S. Thomas

*Attorney, Agent, or Firm*—Neal J. Mosely

[57] ABSTRACT

A sanitary cover for toilet seats comprises a generally flat ended oval envelope of thin flexible material with a central oval opening conforming to the generally oval outline and central opening of a toilet seat shape and has an opening at the flat end portion thereof. The envelope is slidably received on and substantially surrounds the toilet seat with the central opening of the cover disposed at the center of the toilet seat opening in the installed position. The open end of the envelope is cut to define a pair of pull tabs at opposite sides of the envelope for pulling the envelope onto the toilet seat. A small pouch at the front end of the envelope receives and contains the envelope in a rolled or folded condition. The pouch may also be used to slidably pull the envelope off the toilet seat. Alternatively, the central opening may have a reinforcing facing around the edge thereof.

5 Claims, 1 Drawing Sheet

SANITARY TOILET SEAT COVER

BACKGROUND OF THE INVENTION

1. Field of the Invention

This invention relates generally to covers for toilet seats, and more particularly to a sanitary toilet seat cover to prevent contact of the person with the surface of the seat.

2. Brief Description of the Prior Art

Seat covers for toilet seats are known in the art. There are several patents which disclose various pads and covers for toilet seats.

Darms, U.S. Pat. No. 992,173 discloses a reusable toilet pad or cover which may be folded into a compact bundle. The cover comprises a single piece of material shaped to conform to the outline of a toilet seat with a series of hooks riveted adjacent the outer edge which may be swung into position between the edges when the cover is folded. The hooks engage the edge portion of the seat to maintain the cover on the seat. The cover has a loop attached for hanging from a nail.

Quackenbush, U.S. Pat. No. 1,088,090 discloses a reusable toilet seat cover formed of a single piece of flexible material having a cut-away portion at its center in the form of a four leaf clover to provide a series of centrally disposed tabs. The tabs have one member of a snap fastener while the other fastener member is attached to the main body portion of the cover along its outer edge. The tabs are overlapped on the underside of the seat and snapped to the main body to hold the cover on the seat.

Beam, U.S. Pat. No. 1,524,853 discloses a toilet seat cover comprising a rubberized cloth of substantially oval shape with a straight hemmed edge across the back, an oval shaped opening in the center which has a bias facing surrounding the opening, and a hem surrounding the outer periphery of the cover which contains a rubber band. The rubber band draws the edges of the cover under the seat to hold it in place.

Shollar, U.S. Pat. No. 1,530,424 discloses a cushion which is not fastened to a toilet seat, but can be placed thereon. The cushion includes a cardboard base, padding, and a cover for the padding and base. The cover for the pad and base comprises two pieces of material having their adjacent inner edges stitched together forming an opening and is secured over the pad and base by cooperating fastening elements carried by the two pieces of material at points beyond the outer edges of the base.

Nelson, U.S. Pat. No. 1,979,634 discloses a toilet seat cover comprising a continuous ring of crepe paper having its wrinkles or pleats extending transversely of the ring and adapted to stretch circumferentially intermediate of its edges to enclose and cover the toilet seat. The opposite edges of the band are folded over in a double fold which form the center opening when the cover is stretched over the seat. The rear portion of the cover is secured to the seat by spaced inelastic plates or strips of fiber board or lead with bendable ends for engaging the outer edge of the seat. The band may be stretched tightly over the seat by tying a cord between the plates.

The present invention is distinguished over the prior art in general, and these patents in particular by providing a sanitary cover for toilet seats comprising a generally flat ended oval envelope of thin flexible material with a central oval opening conforming to the generally oval outline and central opening of a toilet seat shape and has an opening at the flat end portion thereof. The envelope is slidably received on and substantially surrounds the toilet seat with the central opening of the cover disposed at the center of the toilet seat opening in the installed position. The open end of the envelope is cut to define a pair of pull tabs at opposite sides of the envelope for pulling the envelope onto the toilet seat. A small pouch at the front end of the envelope receives and contains the envelope in a rolled or folded condition. The pouch may also be used to slidably pull the envelope off the toilet seat. Alternatively, the central opening may have a reinforcing facing around the edge thereof.

SUMMARY OF THE INVENTION

It is therefore an object of the present invention to provide a disposable sanitary cover for toilet seats which will prevent contact of body of the user with the seat surface.

It is another object of this invention to provide a disposable sanitary cover for toilet seats which may be thrown away after use.

Another object of this invention is to provide a disposable sanitary cover for toilet seats which may be rolled or folded and stored in a small pouch to occupy a very small space in the stored condition and conveniently carried in a person's purse, briefcase, suitcase, or other articles.

Another object of this invention is to provide a disposable sanitary cover for toilet seats which is particularly useful for travelers and other persons who must use public rest room facilities.

Another object of this invention is to provide a disposable sanitary cover for toilet seats which is easily and quickly placed in position on, and removed from the seat without touching the seat with the hands.

A further object of this invention is to provide a disposable sanitary cover for toilet seats which will aid in the prevention and reduce spreading of any diseases which may be transmitted by contact of the body with toilet seats.

A further object of this invention is to provide a disposable sanitary cover for toilet seats which is easily and inexpensively manufactured from plastic film material and is easily installed and removed in use.

A still further object of this invention is to provide a disposable sanitary cover for toilet seats which is simple in design and construction, economical to manufacture, and rugged and durable in use.

Other objects of the invention will become apparent from time to time throughout the specification and claims as hereinafter related.

The above noted objects and other objects of the invention are accomplished by providing a sanitary cover for toilet seats sanitary cover for toilet seats comprising a generally flat ended oval envelope of thin flexible material with a central oval opening conforming to the generally oval outline and central opening of a toilet seat shape and has an opening at the flat end portion thereof. The envelope is slidably received on and substantially surrounds the toilet seat with the central opening of the cover disposed at the center of the toilet seat opening in the installed position. The open end of the envelope is cut to define a pair of pull tabs at opposite sides of the envelope for pulling the envelope onto the toilet seat. A small pouch at the front end of the envelope receives and contains the envelope in a rolled or folded condition. The pouch may also be used to slidably pull the envelope off the toilet seat. Alternatively, the central opening may have a reinforcing facing around the edge thereof.

DESCRIPTION OF THE PREFERRED EMBODIMENT

Figure 1:
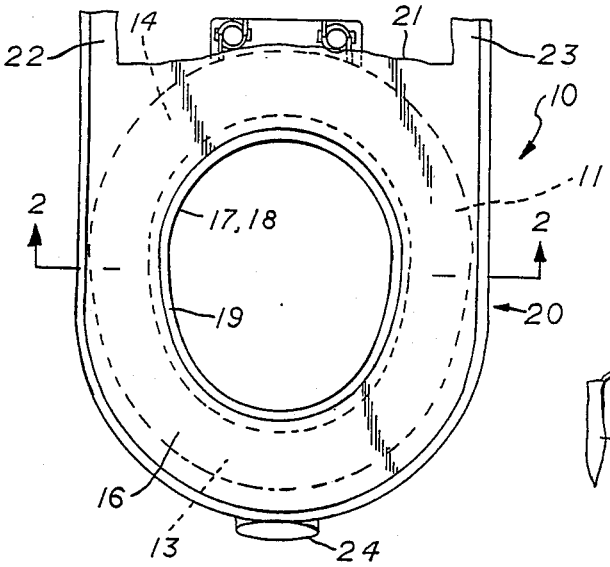
FIG. 1 is a top plan view of the sanitary cover for toilet seats in accordance with the present invention installed on a toilet seat.
Figure 4:
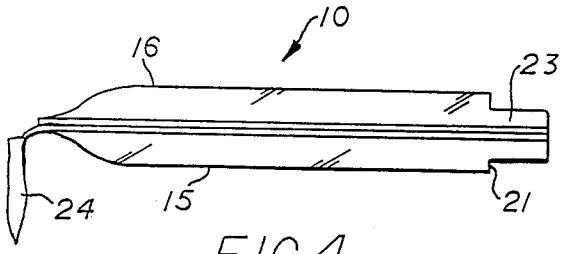
FIG. 4 is a side elevation of the sanitary cover showing one side and the other side being a mirror image thereof.
Figure 2:
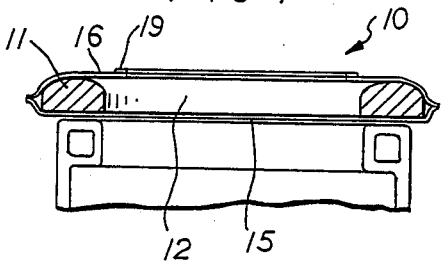
FIG. 2 is a transverse cross sectional view of the cover of FIG. 1 installed on a toilet seat taken along lines 2—2 of FIG. 1.
Figure 5:
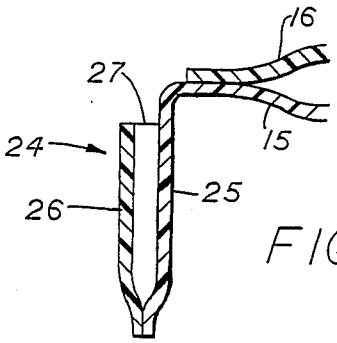
FIG. 5 is an enlarged cross section of the front portion of the sanitary cover showing the pouch attached thereto.

Referring to the drawings by numerals of reference, there is shown a preferred sanitary cover designated generally as 10. In FIG. 1, the cover 10 is shown installed on a oonventional toilet seat 11 having a generally oval shape with the usual centrally disposed generally oval opening 12 therethrough. The front portion of the seat 11 is referred to as 13 and the rear portion of the seat is referred to as 14. The rear portion 14 is hinged to the commode in the usual manner.

The cover 10 is a flat ended oval shaped envelope formed of a first or lower ply 15 and a second or upper ply 16 of suitable thin flexible material, such as polyethylene plastic film. The lower and upper plies 15 and 16 are cut in the generally flat ended oval configuration, and the curved portions of the configuration conform to the generally oval shaped outline of the toilet seat shape.

Figure 3:
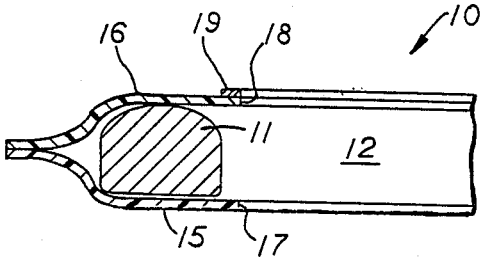
FIG. 3 is an enlarged cross section of a portion of the sanitary cover for toilet seats showing a portion of one side.
Figure 6:
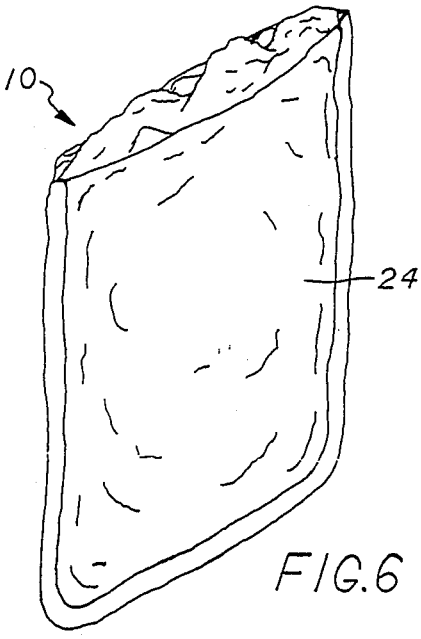
FIG. 6 is a perspective view of the sanitary cover stored in its container pouch.

As best seen in FIG. 3, each ply 15 and 16 has a central cut out portion 17 and 18 to form an opening which conforms to the generally oval shaped opening of the toilet seat, but which is slightly smaller than the toilet seat 12. Alternatively, the inner edge of the cut out portion 18 of the upper ply 16 may have an oval strip or ring of thin flexible material, such as thermoplastic film which is heat welded or otherwise sealed thereto to form a reinforcing facing 19 which surrounds and reinforces the cut out portion 18 to prevent tearing of the material.

The lower and upper plies 15 and 16 are superposed and the outer edges of the superposed plies are heat welded or otherwise sealed together to form a generally U-shaped envelope 20 having an opening at one end. The straight edges of the plies 15 and 16 forming the opening 21 of the U-shaped envelope 20 are unsealed. The width of the envelope 20 is sufficient to be slidably received over the outermost sides of the seat 11.

The unsealed straight edges of the lower and upper plies 15 and 16 are cut out in a rectangular pattern to define a pair of rectangular projections or pull tabs 22 and 23 on opposite sides of the envelope opening 21 The tab members 22 and 23 serve as pull tabs for pulling the envelope 20 onto the seat 11. The lower ply 15 is cut to form a rectangular extension 25 which extends outwardly beyond the curved edge of the oval shape to form a relatively small rectangular bag or pouch 24 at the outer edge of the envelope 20 at the approximate center of its curved portion. The pouch 24 is a rectangular envelope formed of the first ply (extension 25) and a second ply 26 of the same material. The first and second plies 25 and 26 are superposed and heat welded or otherwise secured together on three sides leaving an opening 27 at one end.

The rectangular envelope or pouch 24 can also be formed by cutting both the lower ply 15 and upper ply 16 to have a rectangular extension which extends outwardly beyond the curved edge of the oval shape which are superposed and heat welded or otherwise secured together on three sides. In this method of manufacture, the pouch opening 27 is formed by cutting, or otherwise separating, only the upper ply 16 transversely across at the curved portion.

The size of the pouch 24 is sufficient to receive and contain the cover 10 in a rolled or folded condition. The pouch 24 also serves as a means of pulling the cover off of the seat after use. The pouch containing the stored cover may be easily carried in the purse or pocket of the user. After use, the cover may simply be thrown away, or may be folded or rolled and reinserted into the pouch for reuse or disposal at a convenient location. The pouch also provides a container suitable for use in vending machines in airports, restrooms, and other public facilities.

OPERATION

To use the sanitary cover 10, the user opens the pouch 24 and unfolds or unrolls the cover. Holding the two pull tabs 22 and 23, the user raises both his arms and briskly brings them downward to capture a small amount of air inside the cover sufficient to cause it to assume the oval shaped configuration with the opening 21 open and the plies near the open end separated.

Still holding the tabs, the user inserts the opening of the cover over the front portion 13 of the seat 11 and pulls the tabs 22 and 23 toward the rear of the seat until the seat is surrounded by the cover and the opening 18 of the cover is in the center of the seat opening 12.

After use, the user simply pulls forward on the pouch which is still attached to the front of cover and the cover slides off the seat. The cover may then be thrown away, or may be folded or rolled and reinserted into the pouch for reuse or disposal at a convenient location.

While this invention has been described fully and completely with special emphasis upon a preferred embodiment, it should be understood that within the scope of the appended claims the invention may be practiced otherwise than as specifically described herein.

We claim:

1. A sanitary cover for toilet seats comprising;

two superposed plies of thin flexible plastic film material having a generally flat ended oval shaped configuration conforming to the generally oval outline of a toilet seat shape and the superposed outer edges of the plies sealed together leaving the straight edges at the flat end unsealed to form an envelope having an opening at said flat end, a pair of pull tabs integrally formed on opposite sides of the opening at the flat open end of said envelope for pulling said envelope onto the toilet seat, a centrally disposed generally oval opening in each ply conforming to the outline of the toilet seat opening and slightly smaller than the seat opening, said openings being parallel and coaxial one with the other, said envelope being adapted to be slidably received on and substantially surround a toilet seat with said openings being disposed at the center of the toilet seat opening in the installed position, and a small pouch integrally formed on the outer edge of said envelope at the approximate center of the oval end of the cover for slidably pulling said envelope off the toilet seat and configured to receive and contain said envelope in a rolled or folded condition.

2. A sanitary cover for toilet seats according to claim 1 further including a reinforcing facing strip of thin flexible plastic film material surrounding said aperture in at least one said ply for reinforcing the inner edges of said aperture to prevent tearing of said ply.

3. A sanitary cover for toilet seats according to claim 1 in which said pouch containing said envelope in a rolled or folded condition is of a size and shape suitable for use in vending machines.

4. A sanitary cover for toilet seats according to claim 1 in which said pouch is integrally formed from a rectangular extension of one said ply which extends outwardly beyond the curved edge at the approximate center of the oval end of the cover and a second ply of the same material superposed over the rectangular extension and secured thereto on three outer edges leaving an opening at one end.

5. A sanitary cover for toilet seats according to claim 1 in which said pouch is integrally formed from superposed rectangular extensions of each said ply forming the oval shaped envelope which extend outwardly beyond the curved edge at the approximate center of the cover and the extensions superposed and secured together on three outer edges and one extension separated from its curved portion to define an opening for the pouch.

* * * * *